US005356325A

United States Patent [19]

Awbrey et al.

[11] Patent Number: 5,356,325

[45] Date of Patent: Oct. 18, 1994

[54] WATER FITNESS, THERAPY, SPORT, AND LIFE-PRESERVER FLOTATION SHORTPANT

[76] Inventors: Brian J. Awbrey, 151 Merrimac St. #202; Kipp K. Dye, 151 Merrimac St. #203, both of Boston, Mass. 02114

[21] Appl. No.: 152,539

[22] Filed: Nov. 17, 1993

[51] Int. Cl.[5] ..... A63B 23/00

[52] U.S. Cl. ..... 441/120

[58] Field of Search ..... 441/55, 60, 80, 88, 441/102, 103, 106, 108, 109, 120, 121; 114/215; 434/254; 607/77; 446/153

[56] References Cited

U.S. PATENT DOCUMENTS

| | | | |
|---|---|---|---|
| 1,720,629 | 7/1929 | Dreyfus | 441/120 |
| 3,201,808 | 8/1965 | Glass | 441/102 |
| 4,689,030 | 8/1987 | McWaters | 441/88 |
| 4,993,980 | 2/1991 | Dulin et al. | 441/106 |
| 5,000,710 | 3/1991 | Bedortha et al. | 441/129 |
| 5,083,522 | 1/1992 | Ashrow | 114/215 |
| 5,095,957 | 3/1992 | Herman | 441/106 |
| 5,106,331 | 4/1992 | Lizarazu | 441/55 |

*Primary Examiner*—Stephen P. Avila

*Attorney, Agent, or Firm*—Edwin H. Paul; Jerry Cohen; Harvey Kaye

[57] ABSTRACT

A water sport, fitness, exercise, life preserver, and therapy device (8) including a shortpant design with a flotation waist band (1) , and with an adjustable belt (3) to which flotation modules (10) are attached at various positions around the waist. Pockets (6A) for receiving flotation modules are distributed over the surface of the shortpant. Other material, for example, cups each with an adjustable opening, is arranged to provide adjustable resistance to motion through the water, and the belt has means to attach a tether which the user can exercise by moving to extend the tether. The shortpant is secured to the user via the belt (3) or via suspenders.

6 Claims, 1 Drawing Sheet

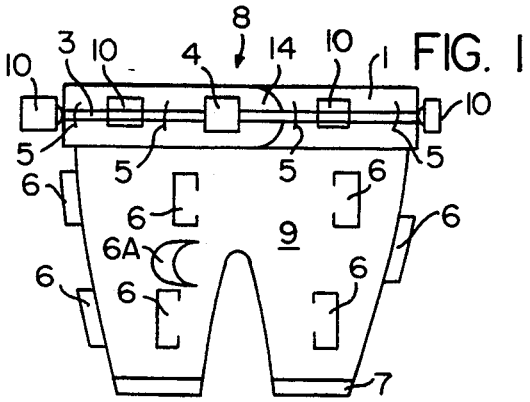
FIG. 1
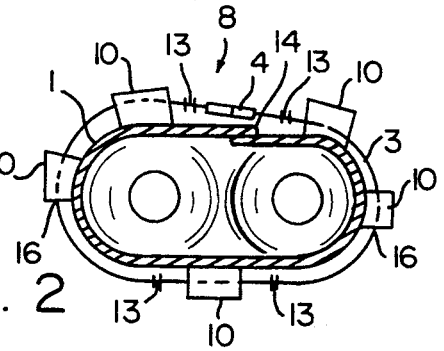
FIG. 2
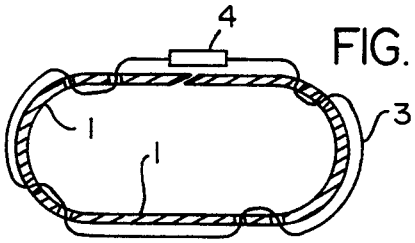
FIG. 3
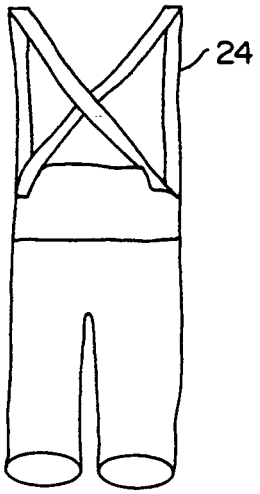
FIG 4
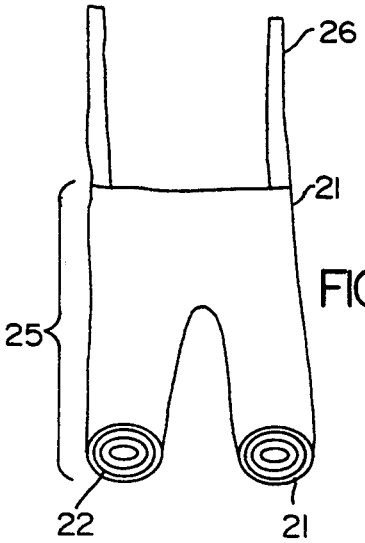
FIG. 5
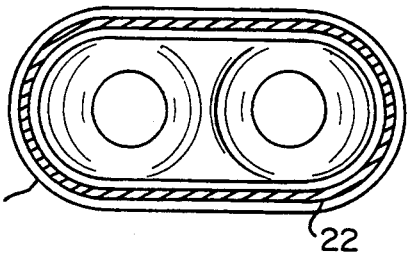
FIG. 5A
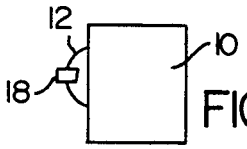
FIG. 6
FIG. 7
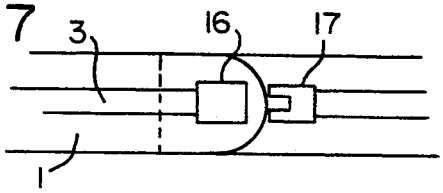

WATER FITNESS, THERAPY, SPORT, AND LIFE-PRESERVER FLOTATION SHORTPANT

FIELD OF THE INVENTION

The present invention relates generally to exercise and fitness flotation devices for use in water, e.g. a pool. Such devices provides flotation support for the user without interference of the upper extremities for a wide range of aquatic exercise training, sporting activities and rehabilitation. Such devices find application to accommodate a variety of body sizes and strengths, including children. and obese or thin individuals.

BACKGROUND OF THE INVENTION

The rise in fitness and sports awareness has led to an appreciation of the benefits of exercising in a water environment. The user may be partially or nearly completely submerged.

Two important benefits of water exercise are: 1) the buoyancy effect on the human body where there is an approximately 90% reduction of pressure on articular joint surfaces, and 2) the hydrostatic pressure that enhances venous blood return to the heart. This hydrostatic pressure increases blood circulation within body tissues and decreases joint swelling distal to the inferior vena cava.

A device presently in use is disclosed in U.S. Pat. No. 5,000,710 ('710), issued on Mar. 19, 1991, for a deep water exercise belt, and U.S. Pat. No. 4,689,030 ('030), issued on Aug. 27, 1987, for a hydrotherapy (wet) vest.

The 710 patent discloses a belt that wraps around the torso of the user just above the anterior superior iliac spines of the pelvis (just above the hips). Here the majority of the flotation material is positioned at the back of the user. This placement forces the user to lean forward pushing the spine and the user into hyperextension resulting in complications which limit rehabilitation, sports application, and fitness training. Another limitation of the '710 device is the propensity of the belt to push up into the arm pits that limits the use of the upper extremities and become uncomfortable, to the point of injury, for the user. In such cases, therapeutic exercise and use of the arms for sporting activities becomes difficult or impossible. Yet another limitation of the '710 device and similar belts is the chafing and accompanying injury to the user's body due to the belt moving relative to the body. Another limitation of such belts stems from the belt's exclusive use of circumferential pressure to hold the belt in place—with no ability to resist upward buoyant forces.

The '030 wet vest wraps around the thorax and traverses up over the shoulders and around both sides of the neck. The vest entirely envelopes the axillae and shoulders. The arms and legs are exposed to the water. In order to keep the vest from "riding" upward on the user, a groin strap, which must be narrow due to the human anatomy, is provided. The vest flotation material (and a vest design that allows use of a large amount of such material) lifts the jacket upward towards the surface of the water. A limitation of such a vest is that there is an inordinate and uncomfortable pressure exerted by the groin strap on the groin that causes pain and restricts the user from performing the full range of motion during exercising.

A further limitation is the inability of the user to freely move his or her arms for sport or exercise, and the device pushes the user into an unnatural spinal hyperextension and hip flexation.

Another limitation in such a vest design is that an individual vest can only accommodate a narrow range of human body sizes (usually slender people). The result is that separate vests must be made for individuals of other sizes. This requirement of many vest sizes acts to limit the application and use of such vests.

A limitation common to both the belt and vest designs is that such designs restrict hip flexion and extension due to their innate design characteristics (as described above).

It is an object of the present invention to provide a device that is comfortable to use, that accommodates a wide range of human body sizes, that allows the buoyant force of the flotation material to be distributed around the torso such that the buoyant force of such flotation material acts at the body's anatomic center and buoyancy (which is optimal), and that allows free use and movement of arms and legs for sport and exercise, and that keeps the spine and body posture in a neutral position for exercise.

It is another object of the present invention to provide for a full range of exercise motion for upper and lower extremities that does not restrict hip motion, that does not require the user assume an unnatural posture of spine hyperextension, and that otherwise accommodates the use of sport and water exercise equipment.

It is yet another object of the present invention to provide a water sport and therapy device that is comfortable to use, that does not chafe the user or exhibit restricting pressure or other such limitation.

Another object of the present invention is to provide a water exercise apparatus with an adjustable water resistance.

It is yet a further object of the present invention to provide a water sport life preserver that allows a full freedom of use and motion of the arms and legs.

SUMMARY OF THE INVENTION

The foregoing objects are met in a new structure designed for providing water therapy and water sport use for a human. The present invention is a water sport and therapy flotation device including a waist to mid-thigh shortpant with an adjustable waist band that accommodates a wide variety of human bodies.

The present invention provides means for attaching and distributing the buoyant force of the flotation material evenly around the thighs, buttocks, abdomen and back of the user's body, without interference with arm or leg motion. The present invention substantially eliminates movement of a device, made in accordance with the present invention, relative to the body, when such a device is actively used in still or moving water.

In a preferred embodiment an adjustable belt is provided and arranged and constructed such that flotation modules can be attached to the flotation belt at various positions around the waist. Such an arrangement allows the number of modules to be adjusted to accommodate the user. The buoyancy force is designed to be circumferentially distributed evenly around the body.

The shortpant, in a preferred embodiment, has belts to draw the pant legs taut at each thigh and about the pelvis to prevent the buoyant force from pulling the shortpant upward into the groin. The belts are secured with elastic, Velcro , or a harness arrangement, and pressure and discomfort at the groin is largely eliminated. This arrangement of flotation provides the optimal circumferential buoyancy force at the user's anatomic center of buoyancy, anterior to the sacrum. Such an application of force allows the user to perform exercises and sports activities without pushing the spine into unnatural hyperextension and/or pelvic tilt. Due to this anatomical buoyancy force positioning, the user's body is free to perform the water exercises and sport activity more easily, and this anatomical buoyancy encourages a more proper anatomic biomechanical fashion than if the buoyant force acted at other locations in the human body.

In a preferred embodiment the shortpant itself is made with flotation material both permanently distributed at various positions on the shortpant itself. and with the ability for modular buoyancy attachments for persons over 250 lbs. In one preferred embodiment, the present invention is arranged and designed for fitness exercises, and another preferred embodiment is designed with more buoyant material as a water sports life preserver.

Other objects, features and advantages will be apparent from the following detailed description of preferred embodiments thereof taken in conjunction with the accompanying drawings in which:

BRIEF DESCRIPTION OF THE DRAWINGS

FIG. 1 is a pictorial of a preferred embodiment in a frontal/view;

FIG. 2 is a top view of the belt configuration of a preferred embodiment;

FIG. 3 is a top view of an alternate method of securing the adjusting belt to the flotation belt;

FIG. 4 is a pictorial depiction of a water sport/life preserver shortpant with crossed suspenders made in accordance with the present invention:

FIG. 5 is a frontal view of a shortpant with straight suspenders and without flotation belt attachments;

FIG. 5A is a top view of the preferred embodiment shortpant of FIG. 5 and FIG. 5A;

FIG. 6 is a side view of a flotation module, and

FIG. 7 is a pictorial of the belt and buckle of a preferred embodiment of the present invention.

DETAILED DESCRIPTION OF THE PREFERRED EMBODIMENTS

In FIGS. 1 and 2, a flotation shortpant device 8 includes an integral waistband 1 with chamfered edges 14. The extent of the chamfered edges allow overlap to accommodate waist sizes of from at least 25 to 45 inches. The shortpant waistband is secured by secured Velcro TM. In other preferred embodiments the attachment is via snaps. An adjustable belt 3 is attached via loops 5 or sewn to the shortpant at the waist. The belt has a buckle 4 that allows the belt to be drawn taut to optionally secure the belt closed. The buckle is of high impact plastic having a male 16 and female 17 component which the user snaps shut and squeezes to release. Such buckles are well known in the art. In another preferred embodiment Velcro TM material is provided to secure the belt. Modules of flotation material 10 are attached to the belt at positions surrounding the waist. This arrangement allows the user to position different size modules at specific points on the belt to encourage buoyancy and anatomic pelvic tilt. The flotation module 10 may be positioned to accommodate different individual user's bodies. For example, the heavy (>250 lbs.) user may add or omit the flotation modules from the outer hip portions of the belt 1 to increase or decrease buoyancy.

Referring to FIG. 2, the belt 3 has two holes 13 on the anterior or posterior part to allow an elastic tether or cord to be passed through the belt with the other end of the tether fixed to a stationary object or another exerciser. The user then works against the tether for exercise. The modules 10 are shown in FIG. 3 with a loop 12 where the module is attached to the belt. The belt has a clip, snap or tie arrangement 18 to prevent the module from riding along the belt. In another preferred embodiment the belt loops 5 may be positioned closely to thereby restrict the module to a position on the belt. In another preferred embodiment the modules have through slots through which the belt passes.

The shortpant material 9 is made to withstand chlorine, sun and water. The material is preferably a fast drying, elastic, mildew resistant material. At the leg ends 7 of the shortpant an elastic band or a short belts are used to secure the shortpant leg to the mid-thigh. The material has an elastic nature in another preferred embodiment.

Referring back to FIG. 1, water catching cups 6 or flaps are distributed over the surface of the shortpant. These cups are made to increase water resistance as the user moves through the water. These cups may be removably attached or permanently sewn to the shortpant. In a preferred embodiment the cups have adjustable openings via zippers or buttons whereby the cup opening is reduced or enlarged to reduce or enlarge the water resistance, respectively. These cups may be attached such that the cup openings face the motion to provide full water resistance to motion in any direction. The cups are arranged in different shortpant surface layout combinations in different preferred embodiments. In another preferred embodiment (not shown) there are pockets 6A are designed and arranged to receive flotation modules. These flotation modules are used to distribute flotation buoyancy forces to the thighs of the user and thus to provide a means to adjust and trim where the resulting buoyancy force acts on the body the pockets 6 have snaps, Velcro TM, and zippers in different preferred embodiments.

In another preferred embodiment the shortpant itself is made of flotation material and so functions without any added modules.

With reference to FIG. 5 and 5A, the shortpant is attached to an extra buoyancy belt 21 that functions as a life preserver. Also the shortpant 25 is made of a thin flotation material 22. FIG. 5A shows thin flotation material 22 encased in a decorative fabric 21. This embodiment does not have a flotation belt since the buoyant material 22 is designed to provide sufficient buoyancy.

Still referring to FIG. 5 and 5A, the suspenders 24 and 26 can be attached to any of the flotation belt or directly to the shortpant. Suspenders provide stability to the shortpant wearer during complicated movements, such as flexion/extension with rotation.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A water fitness flotation shortpant for use by a human comprising:

(a) a shortpant extending from and surrounding the waist to the midthigh of each leg of the user, (b) means for attaching flotation material to the waist of the shortpant, said attachment arranged and constructed to provide buoyant force about at the human anatomical center of buoyancy, by placing said flotation material unequally from the anterior to the posterior of the shortpant, such that the anterior portion is about twice as large as the posterior portion forming a front to back ratio of flotation material of two to one.

2. A shortpant as defined in claim 1 wherein the means to attach comprises: Velcro TM, hooks, or thread that sews the flotation material to the shortpant waist.

3. Shortpant as defined in claim 1 further comprising:

(c) adjustable belt attached to the waist of the shortpant to secure the shortpant to the waist of the user, and (d) elastic means to secure the shortpant leg ends to the mid-thigh of the user, such that the shortpant will not, via buoyant forces, be moved into the groin.

4. Shortpant as defined in claim 1 further comprising:

(c) cup shaped material wherein the cup opening is adjustably closed to allow greater or lesser water resistance, and (d) means for attaching said cup shaped material to said shortpant such that the cup opening faces the motion such that the cup opening provides full resistance to motion in any direction.

5. A water fitness flotation shortpant for use by a human comprising:

(a) a shortpant extending from and surrounding the waist to the midthigh of each leg of the user, and (b) waist band of flotation containing material wherein such flotation material is made from a closed cell foam which provides a contour fit for the user, and where said closed cell foam expands and contracts to accommodate the changes in abdominal girth of the user, and where said waist band is arranged and constructed to provide a resultant buoyant force at the human anatomical center of buoyancy by placing said flotation material unequally from the anterior to the posterior Of the shortpant, such that the anterior portion is about twice as large as the posterior portion forming a front to back ratio of flotation material of two to one.

6. A water fitness flotation shortpant as defined in claim 5 further comprising:

(c) cup shaped material wherein the cup opening is adjustably closed to allow greater or lesser water resistance, and (d) means for attaching said cup shaped material to said shortpant such that the cup opening faces the motion such that the cup opening provides full resistance to motion in any direction.

* * * * *